US009691327B2

(12) United States Patent
Yang

(10) Patent No.: US 9,691,327 B2
(45) Date of Patent: Jun. 27, 2017

(54) PIXEL DRIVING CIRCUIT, DRIVING METHOD THEREOF AND DISPLAY APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventor: Shengji Yang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 68 days.

(21) Appl. No.: 14/646,093

(22) PCT Filed: Sep. 3, 2014

(86) PCT No.: PCT/CN2014/085831

§ 371 (c)(1),
(2) Date: May 20, 2015

(87) PCT Pub. No.: WO2015/188470

PCT Pub. Date: Dec. 17, 2015

(65) Prior Publication Data

US 2016/0267841 A1 Sep. 15, 2016

(30) Foreign Application Priority Data

Jun. 9, 2014 (CN) ..... 2014 1 0253611

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0819* (2013.01);
(Continued)

(58) Field of Classification Search
CPC ..... G09G 3/3225; G09G 3/3233; G06F 3/044
See application file for complete search history.

(56) References Cited

U.S. PATENT DOCUMENTS

2004/0070557 A1 4/2004 Asano et al.
2004/0257353 A1* 12/2004 Imamura ..... G09G 3/3233 345/204

(Continued)

FOREIGN PATENT DOCUMENTS

CN 1684558 A 10/2005
CN 10520986 A 9/2009

(Continued)

OTHER PUBLICATIONS

International Search Report Appln. No. PCT/CN2014/085831; Dated Feb. 27, 2015.

(Continued)

*Primary Examiner* — Gerald Johnson
(74) *Attorney, Agent, or Firm* — Ladas & Parry LLP

(57) ABSTRACT

There is provide a pixel driving circuit, and the pixel driving circuit comprises a driving transistor (DTFT), organic light emitting diode (OLED) connected with the driving transistor (DTFT), a first to a fourth switch transistors (T1~T4) and a storage capacitor (Cs). There is provide a driving method for the pixel driving circuit, and it comprises charging the storage capacitor (Cs); discharging the storage capacitor (Cs), so that a voltage difference exists between voltages at two terminals of the storage capacitor (Cs); changing the data voltage (Vdata), so that the voltages at the two terminals of the storage capacitor (Cs) vary as same as variations (Continued)

in the data voltage (Vdata); and driving the organic light emitting diode (OLED) to emit light. The above pixel driving circuit and the driving method can realize a compensation on the threshold voltage for the driving voltage of the driving transistor (DTFT), and in turn an effect on operating current of the organic light emitting diode (OLED) caused by the threshold voltage is eliminated. There is also provided a display apparatus comprising the above pixel driving circuit.

12 Claims, 5 Drawing Sheets

(52) U.S. Cl.
CPC ..... *G09G 2300/0842* (2013.01); *G09G 2300/0861* (2013.01); *G09G 2310/0251* (2013.01); *G09G 2320/0233* (2013.01); *G09G 2320/045* (2013.01)

(56) References Cited

U.S. PATENT DOCUMENTS

| | | | | |
|---|---|---|---|---|
| 2005/0243036 | A1 | 11/2005 | Ikeda | |
| 2008/0211746 | A1* | 9/2008 | Caligiore | G09G 3/3233 345/76 |
| 2009/0219231 | A1 | 9/2009 | Yamamoto et al. | |
| 2012/0098877 | A1 | 4/2012 | Taro et al. | |
| 2013/0082910 | A1* | 4/2013 | Lee | G09G 3/3208 345/76 |
| 2013/0222440 | A1 | 8/2013 | Ikeda | |
| 2014/0022150 | A1* | 1/2014 | Guo | G09G 3/3233 345/76 |
| 2014/0111562 | A1 | 4/2014 | Wu et al. | |

FOREIGN PATENT DOCUMENTS

| | | | |
|---|---|---|---|
| CN | 101986378 | A | 3/2011 |
| CN | 101996579 | A | 3/2011 |
| CN | 102651198 | A | 8/2012 |
| CN | 102654972 | A | 9/2012 |
| CN | 102682706 | A | 9/2012 |
| CN | 103295524 | A | 9/2013 |
| CN | 104091563 | A | 10/2014 |
| CN | 203870950 | U | 10/2014 |
| JP | 2005-195756 | A | 7/2005 |

OTHER PUBLICATIONS

Written Opinion of the International Searching Authority Appln. No. PCT/CN2014/085831; Dated Feb. 27, 2015.

Third Chinese Office Action dated Aug. 10, 2016; Appln. No. 201410253611.7.

Second Chinese Office Action Appln. No. 201410253611.7; Dated Mar. 10, 2016.

First Chinese Office Action Appln. No. 201410253611.7; Dated Sep. 17, 2015.

* cited by examiner

PIXEL DRIVING CIRCUIT, DRIVING METHOD THEREOF AND DISPLAY APPARATUS

TECHNICAL FIELD

The present disclosure relates to a pixel driving circuit, a driving method thereof and a display apparatus.

BACKGROUND

With the development in a display technique, an organic light emitting diode (OLED) display apparatus has become one of popular display techniques because of its advantages such as simple manufacture process, thinner product, high light brightness, fast response speed, low cost, low operation temperature, etc.

According to different driving manners, the OLED display apparatus can be divided into a Passive Matrix Organic Light Emission Display (PMOLED) and an Active Matrix Organic Light Emission Display (AMOLED). As compared with the PMOLED, the AMOLED has a faster response speed and can satisfy requirements for various sizes of the display apparatus. Therefore, many companies focus on the AMOLED more.

As an original pixel driving circuit for the AMOLED, a structure of a 2T1C pixel driving circuit comprises, as illustrated in FIG. 1, a driving transistor DTFT, a switch transistor T1, an organic light emitting diode OLED and a storage capacitor Cs. When a row is scanned, a scan voltage Vscan is at a low potential, the switch transistor T is turned on, and a data voltage Vdata charges the storage capacitor Cs; when the scanning for this row is completed, the scan voltage Vscan turns to be at a high potential, the switch transistor T is turned off, and the storage capacitor Cs discharges, so that the driving transistor DTFT is in a saturation conduction state, and generates a current to drive the organic light emitting diode OLED, thus ensuring that the organic light emitting diode OLED emits light continuously during a frame of picture.

According to a formula for calculating a leakage current of the transistor, operating current $I_{OLED}$ of the organic light emitting diode OLED satisfies an equation as follows: $I_{OLED}=K(V_{GS}-V_{th})^2$, wherein $V_{GS}$ is a voltage difference between a gate and a source of the driving transistor DTFT, and $V_{th}$ is a threshold voltage of the driving transistor DTFT. Because differences in the processes for different TFTs and other factors such as aging caused by applying a voltage or a high temperature for a long time, and the like, the threshold voltages Vth of the driving transistors DTFTs in different pixel points may shift, such that the current (namely the operating current $I_{OLED}$) flowing through the organic light emitting diodes OLEDs in the respective pixel points becomes inconsistent with each other due to the shifting of the threshold voltage Vth, the brightness at the respective pixel points are different in the display apparatus, and finally a display effect of an entire picture is affected.

SUMMARY

The present disclosure provides a pixel driving circuit, a driving method and a display apparatus, which are capable of improving uniformity in brightness of respective pixel points of the display apparatus and enhancing a display effect of a picture.

The present disclosure adopts solutions as follows.

A pixel driving circuit comprises a driving transistor and an organic light emitting diode connected with the driving transistor, and the pixel driving circuit further comprises the following: a first switch transistor, connected with the driving transistor, the first switch transistor being controlled by a first scan signal and further connected with a power supply voltage; a storage capacitor, connected with the driving transistor; a second switch transistor, connected with the storage capacitor, the second switch transistor being controlled by a second scan signal and further connected with a data voltage; a third switch transistor, connected between a common terminal of the driving transistor and the first switch transistor and a common terminal of the driving transistor and the storage capacitor, the third switch transistor being controlled by a third scan signal; a fourth switch transistor, connected with a common terminal of the driving transistor and the organic light emitting diode, the fourth switch transistor being controlled by the third scan signal and grounded.

In some embodiments, a control terminal of the first switch transistor is connected with the first scan signal, an input terminal thereof is connected with the power supply voltage, and an output terminal thereof is connected with an input terminal of the driving transistor; a control terminal of the second switch transistor is connected with the second scan signal, an input terminal thereof is connected with the data voltage, and an output terminal thereof is connected with a first terminal of the storage capacitor; a second terminal of the storage capacitor is connected with a control terminal of the driving transistor, a control terminal of the third switch transistor is connected with the third scan signal, an input terminal thereof is connected with a common terminal of the driving transistor and the first switch transistor, and an output terminal thereof is connected with a common terminal of the driving transistor and the storage capacitor; a control terminal of the fourth switch transistor is connected with the third scan signal, an input terminal thereof is connected with a common terminal of the driving transistor and the organic light emitting diode, and an output terminal thereof is grounded.

In some embodiments, the first scan signal is different from the second scan signal, and the first switch transistor and the second switch transistor are connected with different scan lines, when types of the first switch transistor and the second switch transistor are the same.

In some embodiments, the types of the driving transistor, the first switch transistor, the second switch transistor, the third switch transistor and the fourth switch transistor are all N-type.

In come embodiments, the first scan signal is the same as the second scan signal, and the first switch transistor and the second switch transistor are connected with the same scan line, when the types of the first switch transistor and the second switch transistor are different.

In some embodiments, the types of the driving transistor, the first switch transistor, the third switch transistor and the fourth switch transistor are N-type, while the type of the second switch transistor is P-type; alternatively, the types of the driving transistor, the second switch transistor, the third switch transistor and the fourth switch transistor are all N-type, while the type of the first switch transistor is P-type.

The present disclosure further provides a driving method for a pixel driving circuit, which may be applied to any one of the pixel driving circuits described above, comprising: charging the storage capacitor; discharging the storage capacitor, so that a voltage difference exists between voltages at two terminals of the storage capacitor; changing the data voltage, so that the voltages at the two terminals of the storage capacitor vary as same as variations in the data voltage; and driving the organic light emitting diode to emit light.

In some embodiments, charging the storage capacitor comprises turning on the first switch transistor, the third switch transistor and the fourth switch transistor, while turning off the second switch transistor, so that the voltage at one terminal of the storage capacitor at which it is connected with the common terminal of the driving transistor and the third switch transistor is charged to the power supply voltage.

In some embodiments, discharging the storage capacitor so that a voltage difference exists between voltages at two terminals of the storage capacitor comprises: turning on the second switch transistor, the third switch transistor and the fourth switch transistor, while turning off the first switch transistor, in order to discharge the voltage at the terminal of the storage capacitor at which it is connected with the common terminal of the driving transistor and the third switch transistor to a threshold voltage of the driving transistor, and a voltage at the terminal of the storage capacitor at which it is connected with the second switch transistor becomes the data voltage.

In some embodiments, changing the data voltage so that the voltages at the two terminals of the storage capacitor vary as same as variations in the data voltage comprises: turning on the second switch transistor, while turning off the first switch transistor, the third switch transistor and the fourth switch transistor; applying a jump signal to the data voltage so that the voltage at the terminal of the storage capacitor at which it is connected with the common terminal of the driving transistor and the third switch transistor becomes a voltage obtained by adding the threshold voltage of the driving transistor to the jump signal, and the voltage at the terminal of the storage capacitor at which it is connected with the second switch transistor becomes a voltage obtained by adding the data voltage to the jump signal.

In some embodiments, the jump signal is decided depending on brightness the organic light emitting diode is required to emit.

In some embodiments, driving the organic light emitting diode to emit light comprises: turning on the first switch transistor, while turning off the second switch transistor, the third switch transistor and the fourth switch transistor, so that the driving transistor drives the organic light emitting diode to emit light.

The present disclosure further provides a display apparatus comprising the pixel driving circuit described above.

In the pixel driving circuit, the driving method thereof and the display apparatus provided in the present disclosure, the driving circuit comprises the driving transistor, the first to the fourth switch transistors and the storage capacitor. As driving the circuit, the voltage differences occurs between the two terminals of the storage capacitor at first by charging and discharging the storage capacitor; and then the data voltage is made to jump, that is, the voltage at one terminal of the storage capacitor jumps, but the storage capacitor would maintain the initial voltage difference to be unchanged because of a bootstrap effect of the capacitor, so that the voltage at the other terminal of the storage capacitor (namely the terminal connected with the driving transistor) would jump equivalently, which realizes a compensation on the threshold voltage for the driving voltage of the driving transistor, and in turn an effect on operating current of the organic light emitting diode caused by the threshold voltage is eliminated, thus completely solving the problem of ununiformity in brightness of the different pixel points caused by variations in threshold voltages of the driving transistors in the different pixel points, and enhancing the display effect of the picture in the display apparatus.

DETAILED DESCRIPTION

Figure 1:
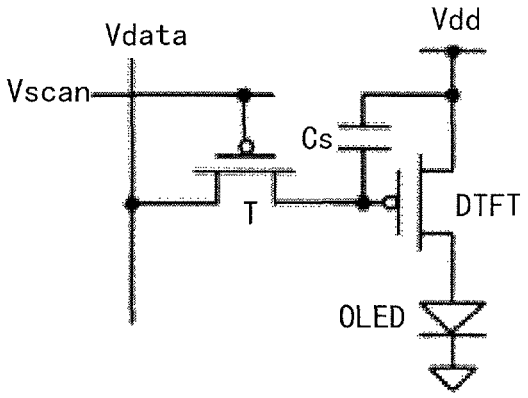
FIG. 1 is a structure diagram of a known pixel driving circuit in the prior art.

In order to make the above features and advantages of the present disclosure understood more clearly and easily, thereinafter, solutions of embodiments of the present disclosure will be described clearly and completely in connection with drawings of the embodiments of the present disclosure. Obviously, the described embodiments are only some, but not all of the embodiments of the present disclosure. Any other embodiments obtained by those ordinary skilled in the art based on the embodiments of the present disclosure without inventive labor should fall into the protection scope of the present disclosure.

First Embodiment

The present embodiment provides a pixel driving circuit, comprising a driving transistor and an organic light emitting diode connected with the driving transistor, and the pixel driving circuit further comprises: a first switch transistor, connected with the driving transistor, the first switch transistor being controlled by a first scan signal and further connected with a power supply voltage; a storage capacitor, connected with the driving transistor; a second switch transistor, connected with the storage capacitor, the second switch transistor being controlled by a second scan signal and further connected with a data voltage; a third switch transistor, connected between a common terminal of the driving transistor and the first switch transistor and a common terminal of the driving transistor and the storage capacitor, the third switch transistor being controlled by a third scan signal; a fourth switch transistor, connected with a common terminal of the driving transistor and the organic light emitting diode, the fourth switch transistor being controlled by the third scan signal and grounded.

Correspondingly, the present embodiment further provides a driving method for the above pixel driving circuit, comprising: charging the storage capacitor; discharging the storage capacitor, so that a voltage difference exists between voltages at two terminals of the storage capacitor; changing the data voltage, so that the voltages at the two terminals of the storage capacitor vary as same as variations in the data voltage; and driving the organic light emitting diode to emit light.

In the pixel driving circuit and the driving method thereof provided in the present embodiment, the driving circuit comprises the driving transistor, the first switch transistor to the fourth switch transistor and the storage capacitor which have the above connection relationship, wherein the first switch transistor receives the first scan signal and the power supply voltage, the second switch transistor receives the second scan signal, the third switch transistor receives the third scan signal and the data voltage, and the fourth switch transistor receives the third scan signal. When the driving is performed, the storage capacitor is controlled to be charged at first and then discharged by performing corresponding turning-on/turning-off actions of the first switch transistor to the fourth switch transistor, therefore a voltage difference occurs at the storage capacitor, then a jump signal is applied to the data voltage input to the second switch transistor, and a voltage at the terminal of the storage capacitor at which it is connected with the driving transistor jumps equivalently by means of a bootstrap effect of the capacitor, thus realizing a compensation on the threshold voltage for the driving voltage of the driving transistor, eliminating an effect on operating current of the organic light emitting diode caused by the threshold voltage, improving the uniformity in the threshold voltages of the driving transistors in different pixel points, and enhancing the display effect of a picture greatly.

Second Embodiment

Figure 2:
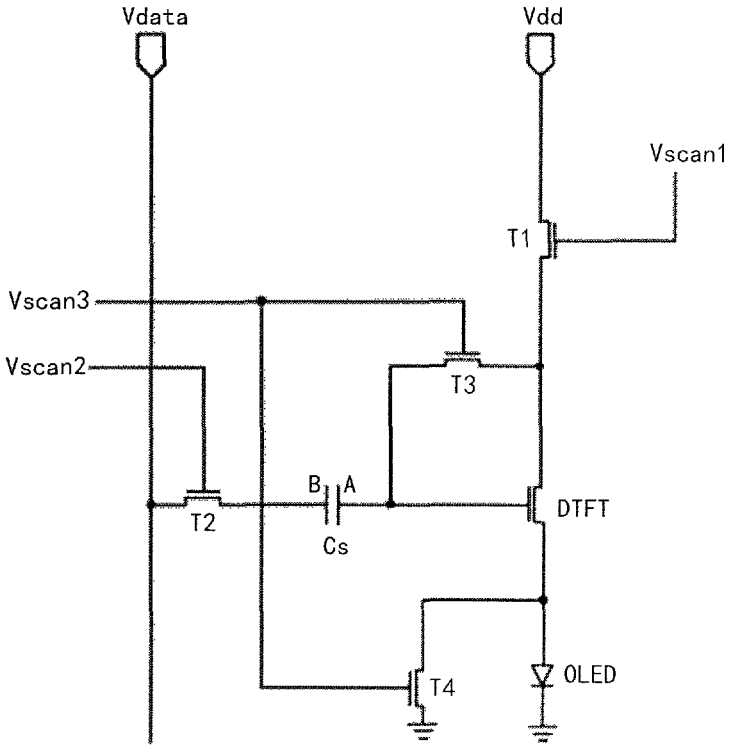
FIG. 2 is a structure diagram of a pixel driving circuit provided in a second embodiment of the present disclosure.

On a basis of the First Embodiment, the present embodiment provides a pixel driving circuit, as illustrated in FIG. 2, this circuit comprises an organic light emitting diode OLED, a driving transistor DTFT, a first switch transistor T1, a second switch transistor T2, a third switch transistor T3, the fourth switch transistor T4 and the a storage capacitor Cs.

Connection relationships among the respective elements described above are the same as those in the pixel driving circuit discussed in the First Embodiment, and one exemplary connection relationship may be as follows.

The organic light emitting diode OLED is connected with an output terminal of the driving transistor DTFT.

A control terminal of the first switch transistor T1 is connected with the first scan signal Vscan1, an input terminal thereof is connected with the power supply voltage Vdd, and an output terminal thereof is connected with an input terminal of the driving transistor DTFT.

A control terminal of the second switch transistor T2 is connected with the second scan signal Vscan2, an input terminal thereof is connected with the data voltage Vdata, and an output terminal thereof is connected with a first terminal of the storage capacitor Cs.

A second terminal of the storage capacitor Cs is connected with a control terminal of the driving transistor DTFT A control terminal of the third switch transistor T3 is connected with the third scan signal Vscan3, an input terminal thereof is connected with a common terminal of the driving transistor DTFT and the first switch transistor T1, and an output terminal thereof is connected with a common terminal of the driving transistor DTFT and the storage capacitor Cs.

A control terminal of the fourth switch transistor T4 is connected with the third scan signal Vscan3, an input terminal thereof is connected with a common terminal of the driving transistor DTFT and the organic light emitting diode OLED, and an output terminal thereof is grounded.

It should be noted that the control terminal used in the present embodiment may be, for example, a gate, the input terminal may be, for example, a source, and the output terminal may be, for example, a drain. The common terminal used in the embodiment of the present disclosure refers to a common connection point thereof.

A driving method for the above circuit is the same as the driving method provided in the First Embodiment, and below an exemplary implementation for the respective steps of the driving method would be described.

At step S1, it is a charging phase. The first switch transistor T1, the third switch transistor T3 and the fourth switch transistor T4 are turned on, while the second switch transistor T2 is turned off, so that the voltage at the terminal of the storage capacitor Cs at which it is connected with the common terminal of the driving transistor DTFT and the third switch transistor T3 is charged to the power supply voltage Vdd.

The terminal of the storage capacitor Cs at which it is connected with the common terminal of the driving transistor DTFT and the third switch transistor T3 is denoted as a terminal A, while the other terminal of the storage capacitor Cs at which it is connected with the second switch transistor T2 is denoted as a terminal B.

Figure 3:
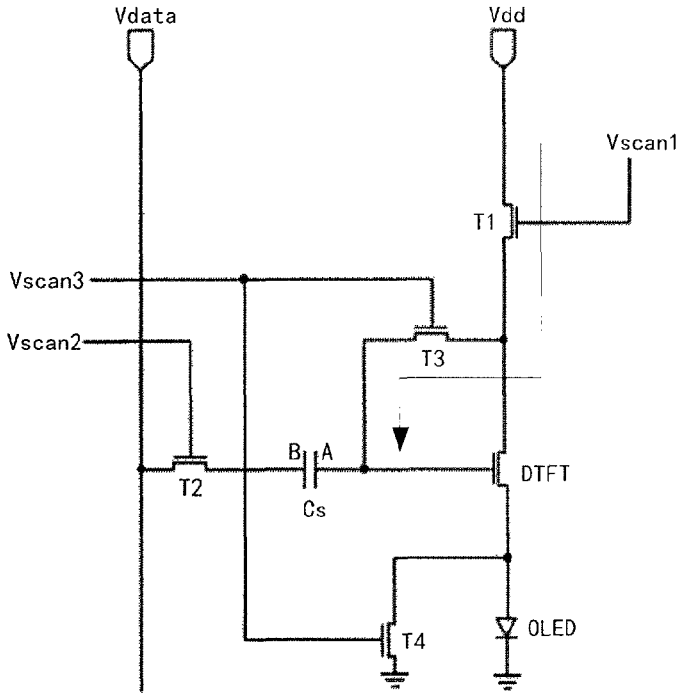
FIG. 3 is a view illustrating a current flowing direction when the pixel driving circuit provided in the second embodiment of the present disclosure is in a charging phase.

During the above phase, a current flowing direction is as illustrated in FIG. 3, that is, current flows through the third switch transistor T3 from the first switch transistor T1, and is stored into the storage capacitor Cs. The voltage at the terminal A of the storage capacitor Cs rises until it rises up to the power supply voltage Vdd, and the charging phase ends.

At step S2, it is a discharging phase. The second switch transistor T2, the third switch transistor T3 and the fourth switch transistor T4 returned on, while the first switch transistor T1 is turned off, in order to discharge the voltage at the terminal of the storage capacitor Cs at which it is connected with the common terminal of the driving transistor DTFT and the third switch transistor T3 to the threshold voltage Vth of the driving transistor DTFT, and the voltage at the terminal of the storage capacitor Cs at which it is connected with the second switch transistor T2 becomes the data voltage Vdata.

After the first switch transistor T1 is turned off, the storage capacitor Cs discharges, the current is released by flowing through the third switch transistor T3, the driving transistor DTFT and the fourth switch transistor T4 from the storage capacitor Cs, and the voltage at the terminal A of the storage capacitor Cs becomes the threshold voltage Vth from the initial power supply voltage Vdd.

After the second switch transistor T2 is turned on, the current flows to the storage capacitor Cs from the second switch transistor T2, and the voltage at the terminal B of the storage capacitor Cs turns to be the data voltage Vdata, so that a voltage difference Vth-Vdata occurs between the terminal A and terminal B of the storage capacitor Cs.

Figure 4:
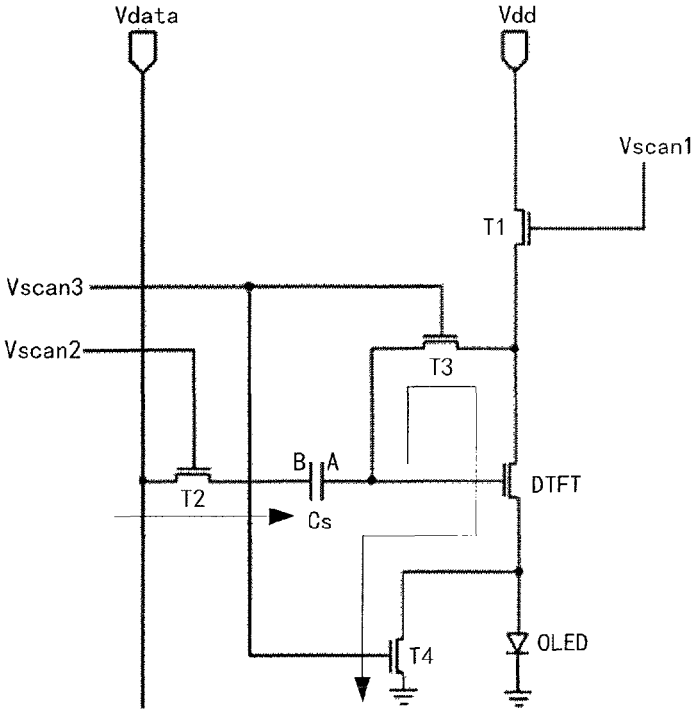
FIG. 4 is a view illustrating a current flowing direction when the pixel driving circuit provided in the second embodiment of the present disclosure is in a discharging phase.

The current flowing direction in the above phase is as illustrated in FIG. 4.

At step S3, it is a compensation phase. The second switch transistor T2 is turned on, while the first switch transistor T1, the third switch transistor T3 and the fourth switch transistor T4 are turned off, a jump signal ΔVdata is applied to the data voltage Vdata, so that the voltage at the terminal of the storage capacitor Cs at which it is connected with the common terminal of the driving transistor DTFT and the third switch transistor T3 turns to be a voltage obtained by adding the threshold voltage Vth of the driving transistor DTFT to the jump signal ΔVdata, and the voltage at the terminal of the storage capacitor Cs at which it is connected with the second switch transistor T2 turns to be a voltage obtained by adding the data voltage Vdata to the jump signal ΔVdata.

Figure 5:
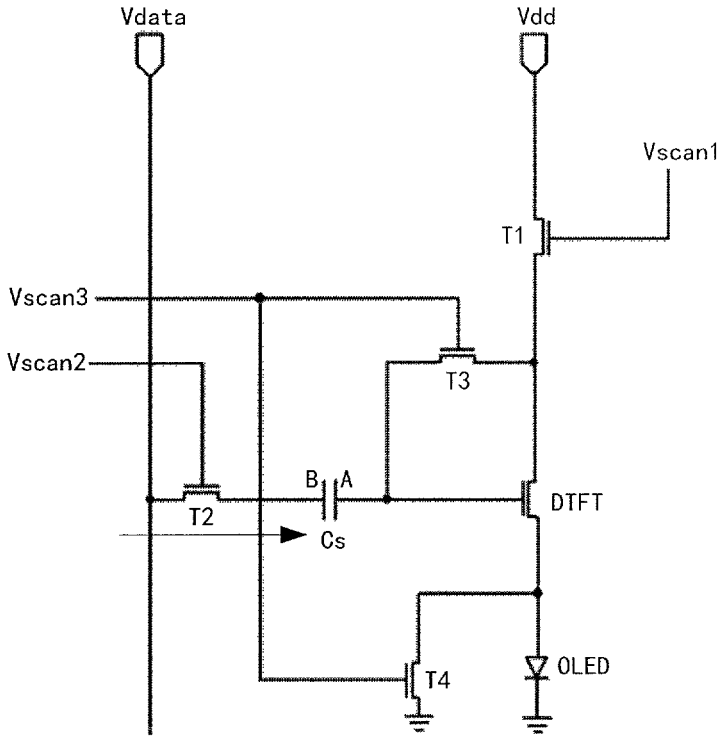
FIG. 5 is a view illustrating a current flowing direction when the pixel driving circuit provided in the second embodiment of the present disclosure is in a compensation phase.

After the third switch transistor T3 and the fourth switch transistor T4 are turned off, and the jump signal ΔVdata is applied to the data voltage Vdata, the current flowing direction is as illustrated in FIG. 5, that is, the current flows to the storage capacitor Cs through the second switch transistor T2, so that the voltage at the terminal B of the storage capacitor Cs jumps to Vdata+ΔVdata. Because of the bootstrap effect of the capacitor, that is, the voltage at one terminal of the capacitor would change equivalently when the voltage at the other terminal of the capacitor changes, in order to keep the original potential difference between the two terminals unchanged. Therefore, in order to keep the potential difference between the terminal A and the terminal B of the storage capacitor Cs (namely Vth−Vdata) unchanged during this phase, the voltage at the terminal A would change to (Vth−Vdata)+(Vdata+ΔVdata)=Vth+ΔVdata after the voltage at the terminal B jumps to Vdata+ΔVdata. This is equivalent to compensate the threshold voltage Vth for the driving voltage of the driving transistor DTFT.

At step S4, it is a light emitting phase. The first switch transistor T1 is turned on, while the second switch transistor T2, the third switch transistor T3 and the fourth switch transistor T4 are turned off, so that the driving transistor DTFT drives the organic light emitting diode OLED to emit light.

Figure 6:
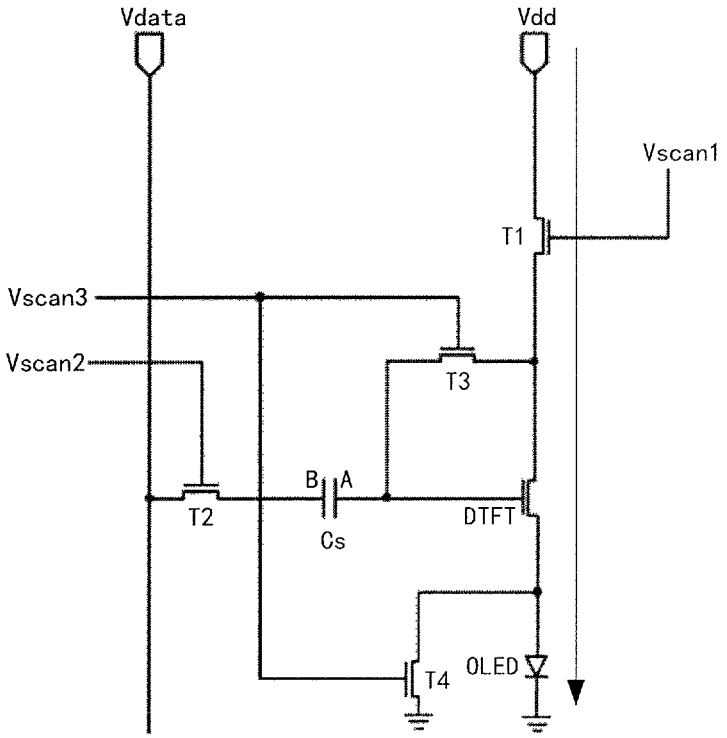
FIG. 6 is a view illustrating a current flowing direction when the pixel driving circuit provided in the second embodiment of the present disclosure is in a light emitting phase.

After the second switch transistor T2 is turned off, and the first switch transistor T is turned on, the current flowing direction is as illustrated in FIG. 6, that is, the current flows through the driving transistor DTFT and the organic light emitting diode OLED from the first switch transistor T sequentially, so that the organic light emitting diode OLED emits light.

In this phase, a voltage $V_G$ at the control terminal of the driving transistor DTFT is the same as the voltage at the terminal A of the storage capacitor Cs, $V_G$=Vth+ΔVdata, a voltage $V_S$ at the input terminal of the driving transistor DTFT is Vdd, $V_S$=Vdd, so the driving voltage (for example, a voltage difference between the gate and source) of the driving transistor DTFT in operation is $V_{GS}=V_G-V_S$=ΔVdata−Vdd; according to the operating current of the OLED, $I_{OLED}=K(V_{GS}-Vth)^2$, the following can be obtain: $I_{OLED}=K(Vth+\Delta Vdata-Vdd-Vth)^2=K(\Delta Vdata-Vdd)^2$. It can be seen that the operating current $I_{OLED}$ of the OLED would not be affected by the threshold voltage Vth of the driving transistor DTFT any more in the light emitting phase of the OLED, and that the problem of un-uniformity in displaying of the picture caused by the variations in threshold voltages Vth of the driving transistors DTFTs in the different pixel points has gone.

It can be seen from the formula for the operating current of the OLED, $I_{OLED}=K(Vth+\Delta Vdata-Vdd-Vth)^2=K(\Delta Vdata-Vdd)^2$, that the operating current of the OLED is depending on the jump signal ΔVdata in the present embodiment, and an amplitude of the operating current is a critical factor affecting the light brightness emitted by OLED, therefore the jump signal ΔVdata is determined by the light brightness the OLED is required to emit. Therefore, in the present embodiment, the ΔVdata may be either a positive value or a negative value, that is to say, the data voltage Vdata may be increased or may also be decreased, which is depending on the ultimate light brightness the OLED is required to emit.

In the pixel driving circuit and the driving method thereof provided in the present embodiment, by applying the jump signal ΔVdata to the data voltage Vdata, that is, by means of adding the jump to the signal during the different phases of driving, the compensation on the threshold voltage Vth of the pixel is achieved, and the effect on the operating current of the OLED caused by the threshold voltage Vth is eliminated, so that a consistency of the operating currents in the respective pixel points is improved, which leads to the uniformity in the brightness of the respective pixel points, and enhances the display effect of an entire picture greatly.

Further, according to the driving method for the pixel driving circuit provided in the present embodiment, it can be seen that no current flows through the organic light emitting diode OLED during the discharge phase (during which the storage capacitor Cs is discharged, so that the voltage difference occurs between the voltages at the two terminals of the storage capacitor Cs) and the compensation phase (during which the data voltage Vdata is changed, so that the voltages at the two terminals of the storage capacitor Cs vary equivalently to the variations in the data voltage Vdata), so that time for continuing light emitting of the organic light emitting diode OLED is reduced, and an effect on a device lifespan caused by a continuing pressure and a high temperature when the organic light emitting diode OLED emits light continuously is decreased, which increases the usage lifespan of the organic light emitting diode OLED to a certain degree.

Further, the pixel driving circuit provided in the present embodiment only comprises five triodes and one capacitor (namely a 5T1C structure), which has a simpler structure and in turn a greater pixel aperture ratio, as compared with driving circuits proposed to realize a pixel compensation, such as 7T1C, 7T2C, etc.

It should be noted that the turning-on or turning-off states of the first switch transistor T1 and the second switch transistor T2 are opposite exactly. Therefore, the first scan signal Vscan1 is different from the second scan signal Vscan2 if the types of the first switch transistor T1 and the second switch transistor T2 are same, and at this time, the first switch transistor T1 and the second switch transistor T2 are connected with different scan lines.

In the present embodiment, there are no limitations on the respective types of the driving transistor DTFT, the first switch transistor T1, the second switch transistor T2, the third switch transistor T3 and the fourth switch transistor T4. They may be N-type, or P-type.

In some embodiments, the types of the driving transistor DTFT, the first switch transistor T1, the second switch transistor T2, the third switch transistor T3 and the fourth switch transistor T4 are same, that is, the structures of the these devices are same. Therefore, these devices can be manufactured with the same process, thus being able to simplify the process.

In some embodiments, the types of the driving transistor DTFT, the first switch transistor T1, the second switch transistor T2, the third switch transistor T3 and the fourth switch transistor 14 are all N-type, so that the structure of the driving circuit is simpler, its implementation is easier and its performance is better.

Figure 7:
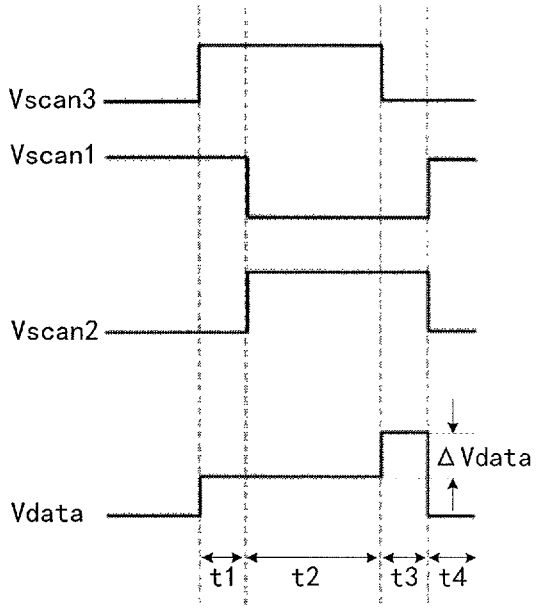
FIG. 7 is a driving timing diagram corresponding to the pixel driving circuit provided in the second embodiment of the present disclosure.

When the types of the driving transistor DTFT, the first switch transistor T1, the second switch transistor T2, the third switch transistor T3 and the fourth switch transistor T4 are all N-type, FIG. 7 shows a view illustrating an exemplary driving timing of the pixel driving circuit provided in the present embodiment, wherein a period t1 corresponds to the charging phase, a period t2 corresponds to the discharging phase, a period t3 corresponds to the compensation phase, and a period t4 corresponds to the light emitting phase.

Exemplarily, in the period t1, the first scan signal Vscan1 and the third scan signal Vscan3 are at a high potential, the first switch transistor T1, the second switch transistor T2 and the fourth switch transistor T4 are turned on, the second scan signal Vscan2 is at a low potential, and the second switch transistor T2 is turned off; the input terminal of the first switch transistor T1 receives the power supply voltage Vdd, and the terminal A of the storage capacitor Cs is charged to the power supply voltage Vdd.

In the period t2, the third scan signal Vscan3 is still at the high potential, the third switch transistor T3 and the fourth switch transistor T4 remains in the turning-on state, the first scan signal Vscan1 turns to be at the low potential, the first switch transistor T1 is turned off, the second scan signal Vscan2 turns to be at the high potential, the second switch transistor T2 is turned on, the terminal A of the storage capacitor Cs is discharged to the threshold voltage Vth, and the voltage at the terminal B is the data voltage Vdata.

In the period t3, the first scan signal Vscan1 is still at the low potential, the first switch transistor T1 remains in the turning-off state, the second scan signal Vscan2 is still at the high potential, the second switch transistor T2 remains in the turning-on state, the third scan signal Vscan3 turns to be at the low potential, the third switch transistor T3 and the fourth switch transistor T4 are turned off, the jump signal ΔVdata is added to the data voltage Vdata, so that the voltage at the terminal B of the storage capacitor Cs becomes Vdata+ΔVdata, and the voltage at the terminal A becomes Vth ΔVdata.

In the period t4, the third scan signal Vscan3 is still at the low potential, the third switch transistor T3 and the fourth switch transistor T4 remain in the turning-off state, the first scan signal Vscan1 turns to be at the high potential, the first switch transistor T1 is turned on, the second scan signal Vscan2 turns to be at the low potential, the second switch transistor T2 is turned off, and the driving transistor DTFT drives the organic light emitting diode OLED to emit light.

It should be noted that above is only illustrative descriptions for the changes of the scan signals when the respective triodes are driven by making a case where the types of these triodes (that is, the driving transistor DTFT, the first switch transistor T1, the second switch transistor T2, the third switch transistor T3 and the fourth switch transistor T4) are N-type as an example. However, in other embodiments of the present disclosure, the types of the respective triodes can be determined depending on actual requirements, and the changes of the scan signals for the respective triodes can be determined correspondingly.

Third Embodiment

Figure 8:
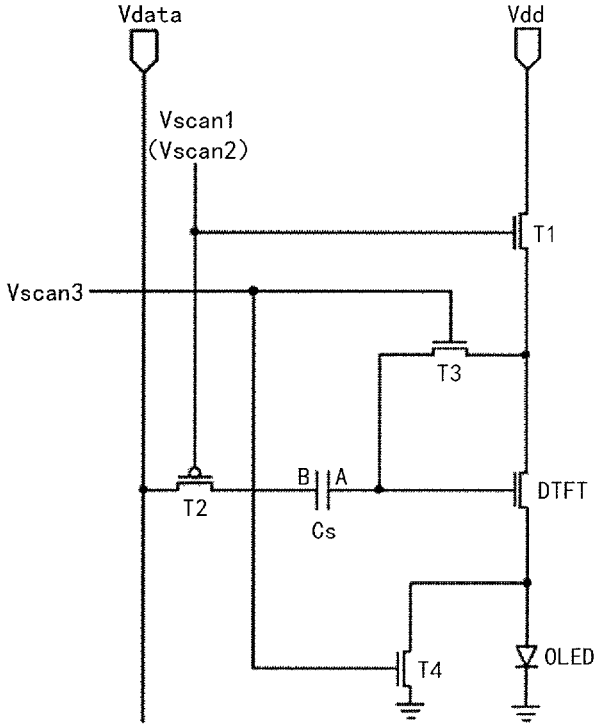
FIG. 8 is a structure diagram of a pixel driving circuit provided in the third embodiment of the present disclosure.

The first scan signal is as same as the second scan signal, and the first switch transistor and the second switch transistor may be, for example, connected with a same scan line, when the types of the first switch transistor and the second switch transistor are different. Base on this, the present embodiment provides a pixel driving circuit whose structure is as illustrated in FIG. 8, the first switch transistor T1 and the second switch transistor T2 are connected with the same scan line, and controlled by the same scan signal. At this time, the type of the first switch transistor T1 may be N-type, while the type of the second switch transistor T2 may be P-type; alternatively, the type of the first switch transistor T1 may be P-type, while the type of the second switch transistor T2 may be N-type.

The driving method for the pixel driving circuit provided in the present embodiment is the same as the driving method described in the First Embodiment previously, and its details are not repeated herein.

Figure 9:
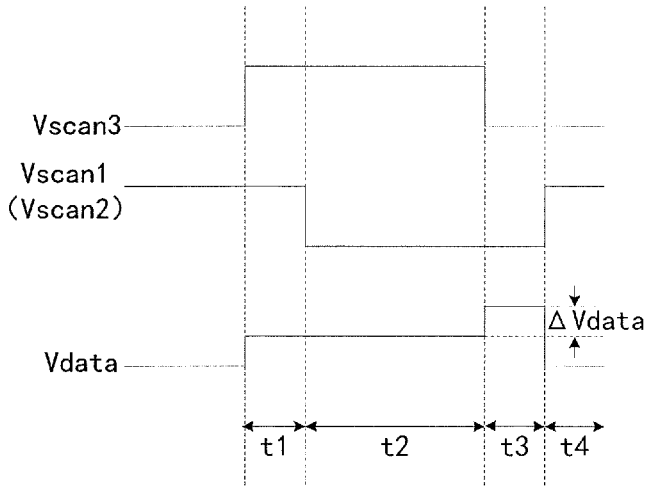
FIG. 9 is a driving timing diagram corresponding to the pixel driving circuit provided in the third embodiment of the present disclosure.
Figure 10:
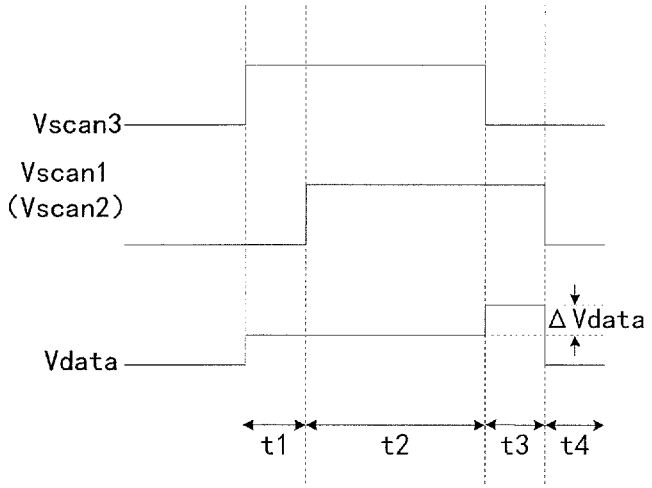
FIG. 10 is another driving timing diagram corresponding to the pixel driving circuit provided in the third embodiment of the present disclosure.

If the types of the driving transistor DTFT, the first switch transistor T1, the third switch transistor T3 and the fourth switch transistor T4 are all N-type, while the type of the second switch transistor T2 is P-type, the driving timing diagram of the pixel driving circuit in the present embodiment is as illustrated in FIG. 9; and if the types of the driving transistor DTFT, the second switch transistor T2, the third switch transistor T3 and the fourth switch transistor T4 are all N-type, while the type of the first switch transistor T1 is P-type, the driving timing diagram of the pixel driving circuit in the present embodiment is as illustrated in FIG. 10.

For the both cases, the variations in the third scan signal Vscan3 and the data voltage Vdata input to the third switch transistor T3 and the fourth switch transistor 14 are the same as the variations in the third scan signal Vscan3 and the data voltage Vdata input to the third switch transistor T3 and the fourth switch transistor T4 discussed in the Second Embodiment wherein the first switch transistor T1 and the second switch transistor T2 are connected with the different scan lines, and the variations in the scan signals input to the first switch transistor T1 and the second switch transistor T2 are the same. Therefore, the turning on and turning-off states of the two are opposite exactly.

In the pixel driving circuit provided in the present embodiment, the first switch transistor and the second switch transistor can be controlled by the same scan line by make the types of the first switch transistor and the second switch transistor different, so that the number of the scan lines in the circuit is decreased to two, further simplifying the circuit structure and the driving method.

Fourth Embodiment

The present embodiment provides a display apparatus comprising the pixel driving circuit described in the First Embodiment to the Third Embodiment.

In the display apparatus provided in the present disclosure, by means of adding the jump to the signal during the different phases of driving, the compensation on the threshold voltage of the pixel is achieved, the effect on the operating current of the organic light emitting diode caused by the threshold voltage is eliminated, thus a problem of un-uniformity in brightness of the different pixel points caused by variations in threshold voltages of the driving transistors in the different pixel points is settled completely, and the display effect of the picture in the display apparatus is enhanced.

Further, during an operation process of the display apparatus provided in the present embodiment, no current flows through the organic light emitting diode during the discharge phase and the compensation phase, so that time for continuing light emitting of the organic light emitting diode is reduced, and an effect on the lifespan of the organic light emitting diode caused by a continuing pressure and a high temperature when the organic light emitting diode emits light continuously is decreased, which increases the usage lifespan of the organic light emitting diode.

The above descriptions only illustrate the specific embodiments of the present invention, and the protection scope of the present invention is not limited to this. Given the teaching as disclosed herein, variations or substitutions, which can easily occur to any skilled pertaining to the art, should be covered by the protection scope of the present invention. Thus, the protection scope of the present invention is defined by the claims.

This application claims priority to a Chinese Patent Application No. 201410253611.7, filed on Jun. 9, 2014, in the China's State Intellectual Property Office, the disclosure of which is incorporated by reference herein as a whole.

What is claimed is:

1. A pixel driving circuit, comprising a driving transistor and an organic light emitting diode connected with the driving transistor, wherein the pixel driving circuit further comprises:

a first switch transistor, connected with the driving transistor, the first switch transistor being controlled by a first scan signal and further connected with a power supply voltage;

a storage capacitor, connected with the driving transistor;

a second switch transistor, connected with the storage capacitor, the second switch transistor being controlled by a second scan signal and further connected with a data voltage;

a third switch transistor, connected between a common terminal of the driving transistor and the first switch transistor and a common terminal of the driving transistor and the storage capacitor, the third switch transistor being controlled by a third scan signal; and a fourth switch transistor, connected with a common terminal of the driving transistor and the organic light emitting diode, the fourth switch transistor being controlled by the third scan signal and grounded, wherein the first scan signal is the same as the second scan signal, and the first switch transistor and the second switch transistor are connected with a same scan line, when the types of the first switch transistor and the second switch transistor are different.

2. The pixel driving circuit of claim 1, wherein a control terminal of the first switch transistor is connected with the first scan signal, an input terminal thereof is connected with the power supply voltage, and an output terminal thereof is connected with an input terminal of the driving transistor;

a control terminal of the second switch transistor is connected with the second scan signal, an input terminal thereof is connected with the data voltage, and an output terminal thereof is connected with a first terminal of the storage capacitor;

a second terminal of the storage capacitor is connected with a control terminal of the driving transistor;

a control terminal of the third switch transistor is connected with the third scan signal, an input terminal thereof is connected with a common terminal of the driving transistor and the first switch transistor, and an output terminal thereof is connected with a common terminal of the driving transistor and the storage capacitor; and a control terminal of the fourth switch transistor is connected with the third scan signal, an input terminal thereof is connected with a common terminal of the driving transistor and the organic light emitting diode, and an output terminal thereof is grounded.

3. The pixel driving circuit of claim 1, wherein the types of the driving transistor, the first switch transistor, the third switch transistor and the fourth switch transistor are all N-type, while the type of the second switch transistor is P-type; or, the types of the driving transistor, the second switch transistor, the third switch transistor and the fourth switch transistor are all N-type, while the type of the first switch transistor is P-type.

4. A driving method for a pixel driving circuit, which is applied to the pixel driving circuits of claim 1, comprising:

charging the storage capacitor;

discharging the storage capacitor, so that a voltage difference exists between voltages at two terminals of the storage capacitor;

changing the data voltage, so that the voltages at the two terminals of the storage capacitor vary as same as variations in the data voltage; and driving the organic light emitting diode to emit light.

5. The driving method for the pixel driving circuit of claim 4, wherein the charging the storage capacitor comprises turning on the first switch transistor, the third switch transistor and the fourth switch transistor, while turning off the second switch transistor, so that the voltage at one terminal of the storage capacitor at which it is connected with the common terminal of the driving transistor and the third switch transistor is charged to the power supply voltage.

6. The driving method for the pixel driving circuit of claim 5, wherein the discharging the storage capacitor so that a voltage difference exists between voltages at two terminals of the storage capacitor comprises turning on the second switch transistor, the third switch transistor and the fourth switch transistor, while turning off the first switch transistor, in order to discharge the voltage at the terminal of the storage capacitor at which it is connected with the common terminal of the driving transistor and the third switch transistor to a threshold voltage of the driving transistor, and a voltage at the terminal of the storage capacitor at which it is connected with the second switch transistor becomes the data voltage.

7. The driving method for the pixel driving circuit of claim 6, wherein the changing the data voltage so that the voltages at the two terminals of the storage capacitor vary as same as variations in the data voltage comprises turning on the second switch transistor, while turning off the first switch transistor, the third switch transistor and the fourth switch transistor; applying a jump signal to the data voltage, so that the voltage at the terminal of the storage capacitor at which it is connected with the common terminal of the driving transistor and the third switch transistor becomes a voltage obtained by adding the threshold voltage of the driving transistor to the jump signal, and the voltage at the terminal of the storage capacitor at which it is connected with the second switch transistor becomes a voltage obtained by adding the data voltage to the jump signal.

8. The driving method for the pixel driving circuit of claim 7, wherein the jump signal is decided depending on brightness the organic light emitting diode is required to emit.

9. The driving method for the pixel driving circuit of claim 8, wherein the driving the organic light emitting diode to emit light comprises turning on the first switch transistor, while turning of the second switch transistor, the third switch transistor and the fourth switch transistor, so that the driving transistor drives the organic light emitting diode to emit light.

10. A display apparatus comprising the pixel driving circuit of claim 1.

11. The display apparatus of claim 10, wherein a control terminal of the first switch transistor is connected with the first scan signal, an input terminal thereof is connected with the power supply voltage, and an output terminal thereof is connected with an input terminal of the driving transistor;

a control terminal of the second switch transistor is connected with the second scan signal, an input terminal thereof is connected with the data voltage, and an output terminal thereof is connected with a first terminal of the storage capacitor;

a second terminal of the storage capacitor is connected with a control terminal of the driving transistor;

a control terminal of the third switch transistor is connected with the third scan signal, an input terminal thereof is connected with a common terminal of the driving transistor and the first switch transistor, and an output terminal thereof is connected with a common terminal of the driving transistor and the storage capacitor; and a control terminal of the fourth switch transistor is connected with the third scan signal, an input terminal thereof is connected with a common terminal of the driving transistor and the organic light emitting diode, and an output terminal thereof is grounded.

12. The display apparatus of claim 10, wherein the types of the driving transistor, the first switch transistor, the third switch transistor and the fourth switch transistor are all N-type, while the type of the second switch transistor is P-type; or, the types of the driving transistor, the second switch transistor, the third switch transistor and the fourth switch transistor are all N-type, while the type of the first switch transistor is P-type.

* * * * *